US009266127B2

(12) United States Patent
Sato et al.

(10) Patent No.: US 9,266,127 B2
(45) Date of Patent: Feb. 23, 2016

(54) SANITARY SHOWER

(71) Applicant: Hansgrohe SE, Schiltach (DE)

(72) Inventors: Oki Sato, Tokyo (JP); Joachim Blattner, Haslach (DE); Hubert Moosmann, Schiltach (DE)

(73) Assignee: Hansgrohe SE, Schiltach (DE)

( * ) Notice: Subject to any disclaimer, the term of this patent is extended or adjusted under 35 U.S.C. 154(b) by 22 days.

(21) Appl. No.: 14/311,716

(22) Filed: Jun. 23, 2014

(65) Prior Publication Data

US 2015/0028130 A1 Jan. 29, 2015

(30) Foreign Application Priority Data

Jul. 24, 2013 (DE) ..... 10 2013 214 500

(51) Int. Cl.

| | |
|---|---|
| ***B05B 1/14*** | (2006.01) |
| ***B05B 1/18*** | (2006.01) |
| ***F21V 33/00*** | (2006.01) |
| *B05B 13/02* | (2006.01) |
| *B05B 15/06* | (2006.01) |

(52) U.S. Cl.

CPC ..... *B05B 1/185* (2013.01); *F21V 33/004* (2013.01); *B05B 13/0278* (2013.01); *B05B 15/065* (2013.01)

(58) Field of Classification Search

CPC ..... B05B 1/18; B05B 1/185; B05B 1/1654; B05B 15/066; E03C 1/0408

USPC ..... 239/556, 558, 598, 589

See application file for complete search history.

(56) References Cited

FOREIGN PATENT DOCUMENTS

| | | | | |
|---|---|---|---|---|
| CN | 201454722 | * | 6/2009 | ..... B05B 15/066 |
| CN | 201565375 | * | 12/2009 | ..... B05B 15/066 |
| DE | 202004016297 | * | 6/2005 | ..... B05B 15/066 |

OTHER PUBLICATIONS

Blog page www.flodeau.com, Jul. 2013, Florence Deau.
Examination report, DE 10 2013 214 500.4, Apr. 3, 2014.

* cited by examiner

*Primary Examiner* — Davis Hwu
(74) *Attorney, Agent, or Firm* — Duane Morris LLP

(57) ABSTRACT

A sanitary shower has a shower body, a water inlet on the shower body connectable to a wall supply line, at least one jet outlet opening and a water conduit providing fluid communication to the water inlet. The sanitary shower includes a connector body with a water inlet connectable to a wall supply line and a basket-type shower body which extends from the connector body up to an outlet-sided basket terminal axially spaced from the connector body. The basket-type shower body defines a hollow basket interior space adjacent to the connector body, and the outlet-sided basket terminal delimits an axial basket opening and/or a light transparent terminal disk element. On the basket-type shower body and/or on the connector body at least one jet outlet opening is provided. A water conduit provides a fluid communication of the at least one jet outlet opening to the water inlet.

18 Claims, 13 Drawing Sheets

28
27
26
25
5
9
3'
1
15
14
14a
2
21
20
11
16
18
17

SANITARY SHOWER

FIELD OF THE INVENTION

The invention relates to a sanitary shower having a shower body and a connector body, a water inlet on the connector body that is connectable to a ceiling or wall supply line, at least one jet outlet opening and having a water conduit providing a fluid communication of the at least one jet outlet opening to the water inlet.

BACKGROUND

Sanitary showers of this type are in use in particular as head showers, hand showers and side showers. In the conventional manner, the shower body is most commonly formed by a cylindrical shower housing which, on an outlet-sided end side, displays a jet disk having a plurality of jet outlet openings and, on another side, e.g. on the opposite end side or on the cylinder-jacket face, has the water inlet and is otherwise implemented in a closed manner. In the case of these conventional showers various shower-head components, such as water containing duct structures of the housing, water containing inserts, valves and similar, are accommodated in the housing, wherein the jet disk conceals from view these internal components of the conventional shower heads from the outlet side and completely covers them. The jet pattern which is generated by the sanitary shower is a result of the arrangement and the implementation of the jet outlet openings, wherein corresponding types of known showers make possible a plurality of different jet patterns, the user being able to switch from one to the other by way of an operating element which is provided on the shower housing or on the jet disk.

It is in particular for head showers that other shower-head designs which are less restricted in their design have also already been proposed, including such having an annular shower-jet outlet body or having a plate-shaped shower-jet outlet body in which an illumination may be integrated.

It is an object of the invention to provide a sanitary shower of the type mentioned at the outset by way of which the diversity of shapes and functions can be significantly widened in comparison to the known sanitary showers mentioned above.

This and other objects are achieved by providing a sanitary shower which comprises a connector body and a basket-type shower body disposed thereon. The connector body includes a water inlet connectable to a wall supply line. The wall supply line may be one which leads to a water supply connector on a ceiling wall or side wall of a shower room, for example.

The shower body is characteristically implemented in a basket-type manner, wherein it extends from the connector body up to an outlet sided basket terminal axially spaced from the connector body. The term outlet sided basket terminal here is to be understood to mean that side of the basket-type shower body that faces the user during operation and faces away from the connector body. Depending on requirements and on the type of application, the basket-type shower body is implemented as an open frame-type or aperture-type shower basket or as a closed lampshade-like shower basket. The water inlet is situated on an inlet side which lies opposite the outlet sided basket terminal or may be situated transversely to the axial direction of the basket-type shower body, on the connector body. The basket-type structure of the shower body defines, i.e. delimits a hollow basket interior space adjacent to the disk-shaped connector body. The outlet-sided basket terminal delimits an axial basket opening and/or a light transparent terminal disk element. Moreover, the sanitary shower includes one or more jet outlet openings which are provided on the basket-type shower body and/or on the connector body. A water conduit provides a fluid communication of the at least one jet outlet opening to the water inlet.

On account of the mentioned features the sanitary shower according to the invention enables a significant widening of the potential in terms of design and function of the entire shower body itself and also of providing advantageous jet patterns and jet characteristics of the shower jet(s) which can be generated by the sanitary shower. Depending on requirements, a plurality of jet outlet openings in various different arrangements may be provided on the basket-type shower body and/or on the connector body in this manner. The basket shape of the basket-type shower body may be varied in many different ways and be optimized according to standpoints of design and/or functionality. The same applies to, for example, the disk-shaped implementation of the connector body. The basket opening delimited by the outlet sided basket terminal, in terms of size, may be chosen depending on requirements, for example as a comparatively large opening which may extend over practically the entire basket cross section or as a tighter opening in comparison thereto.

In the embodiments in which the outlet sided basket terminal displays the light transparent terminal disk element, the latter may, as desired, leave or delimit, respectively, an axial basket opening or terminate the hollow basket interior space on the outlet side as a light transparent face. The characterizing term "light transparent" here is to be understood to mean both embodiments in which the terminal disk element is transparent to the observer and such which are opaque but, to illumination light, are at least part-transparent or which can emit diffused light or fluorescent light.

In one advantageous refinement of the invention, the basket-type shower body is configured so as to be bell-shaped and extends as a corresponding shower-body bell from the connector body with a radial main direction component up to an upper basket circumferential region and from there with an axial main direction component up to the outlet sided basket terminal. In this case, too, depending on requirements, open frame-type or alternatively closed bell shapes are possible for the basket-type shower body.

In one advantageous refinement of the invention the basket-type shower body includes a plurality of basket tubes arranged distributed over the basket circumferential direction to form a basket. Using these shower tubes, the basket-type shower body can provide an open basket frame. Alternatively, the basket tubes may carry a cover, if the shower basket is to be implemented in a closed manner.

In one refinement of the invention a plurality of jet outlet openings are provided on the outlet-sided basket terminal. In alternative or combined embodiments, the outlet-sided basket terminal, to this end, may have an annular and/or light transparent jet outlet disk having one or more jet outlet openings and/or at least one annular jet outlet tube having one or more jet outlet openings on a tube-jacket side and/or at least one radial jet outlet tube having a plurality of jet outlet openings on a tube jacket side. This enables numerous different variants of designs and jet patterns.

It is possible, in this manner, for a jet outlet region to include a plurality of jet outlet openings in a plane, preferably disposed in a round arrangement or circumferentially in an annular arrangement, advantageously but not necessarily on a continuous component, such as a jet disk. Here at least two such jet outlet regions may be provided, advantageously on different components and/or regions or at different axial spacing, respectively, preferably in relation to an axis of a rotational symmetry.

It is furthermore possible for a plurality of jet outlet openings to be arranged in different angles relative to one another. The jet outlet openings here in particular are in each case arranged in groups or form groups, respectively. Within one group the angular alignment is in each case identical, specifically either parallel with or coincidental with an axis which advantageously runs centrically through the group, preferably as an axis of a rotational symmetry. These groups of jet outlet openings may be provided in each case along closed lines or rings and/or exactly in one plane.

In one refinement of the invention the basket-type shower body includes at least one water containing tube, which tube is a component of the water conduit from the water inlet to the jet outlet opening(s). The water containing tube preferably simultaneously functions as a component of the shower-basket structure.

In one refinement of the invention, the connector body includes one or more jet outlet openings on an outlet side facing the basket interior. This enables a jet pattern in which a water jet exits from the connector body into the basket interior space, traverses the latter and then axially exits on the outlet sided basket terminal. If desired, additional water jets may exit via corresponding jet outlet openings at pre-definable points from the basket-type shower body itself.

In one advantageous refinement of the invention an illuminant is disposed in the basket interior, which illuminant is attached to the connector body or to the basket-type shower body. In this embodiment the function of providing the water jet of the shower is combined with an illuminating function. On account of arranging the illuminant in the basket interior space, the basket-type shower body thus adopts a type of lampshade function.

In the embodiment of this measure, the illuminant is an electric illuminant of which the electrical supply passes through the water inlet. Therefore, no separate electrical supply opening is required in the connector body or in the shower body.

In one refinement of the invention the sanitary shower includes a support and supply tube, in the form of an overhead shower ceiling wall support or an overhead shower side wall support or a lateral shower side wall support or a hand-held shower handle, and a water outlet section capable of being coupled to the water inlet of the connector body. The sanitary shower may thus be used as a head shower, a side shower or a hand shower, as desired.

BRIEF DESCRIPTION OF THE DRAWINGS

Advantageous embodiments of the invention are illustrated in the drawings and are described in the following. In the drawings.

DETAILED DESCRIPTION OF THE EXEMPLARY EMBODIMENTS

Figure 1:
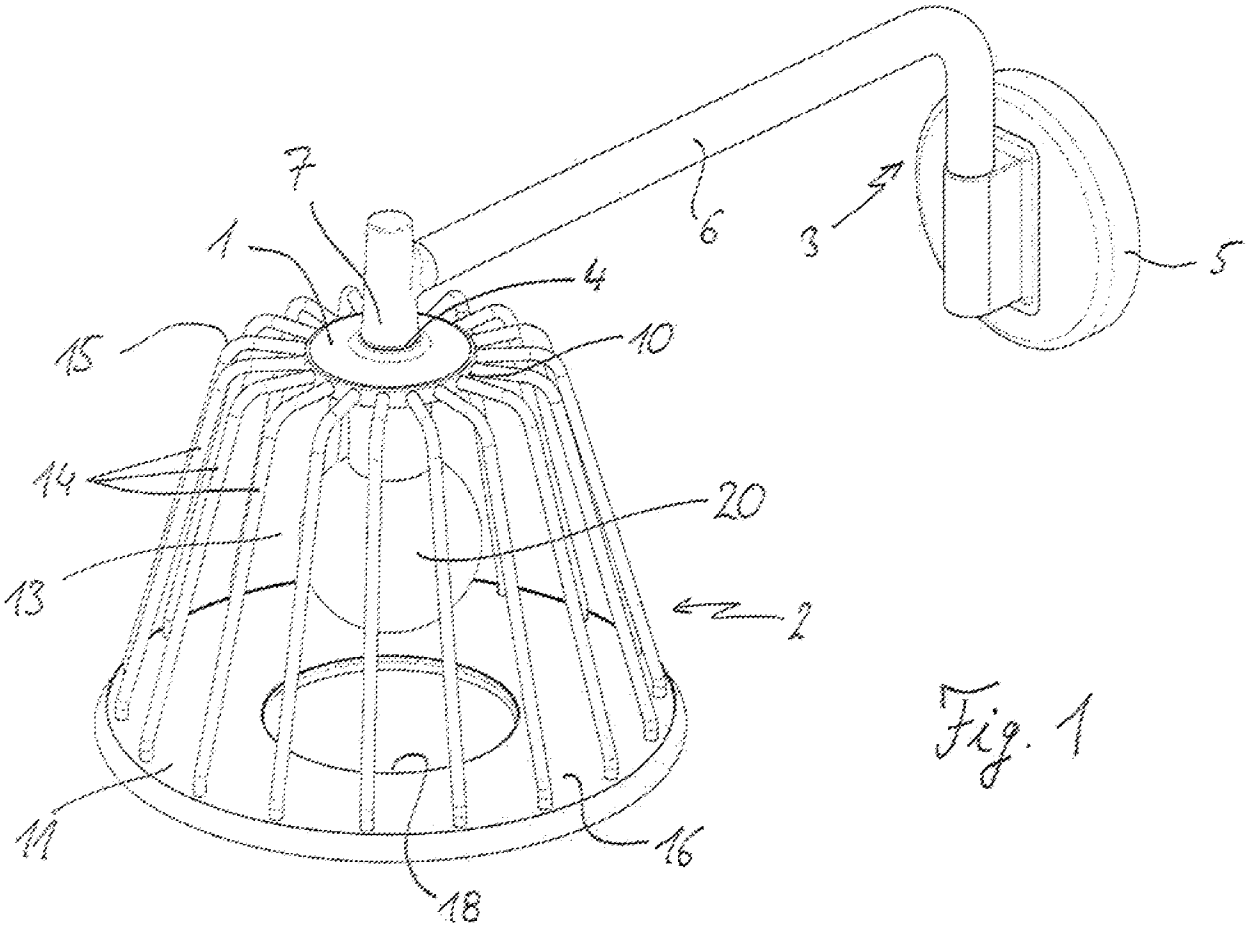
FIG. 1 shows a perspective view of a head shower having a wall support and a basket-type shower body having a jet disk in the shape of an annular disk on the basket outlet.
Figure 2:
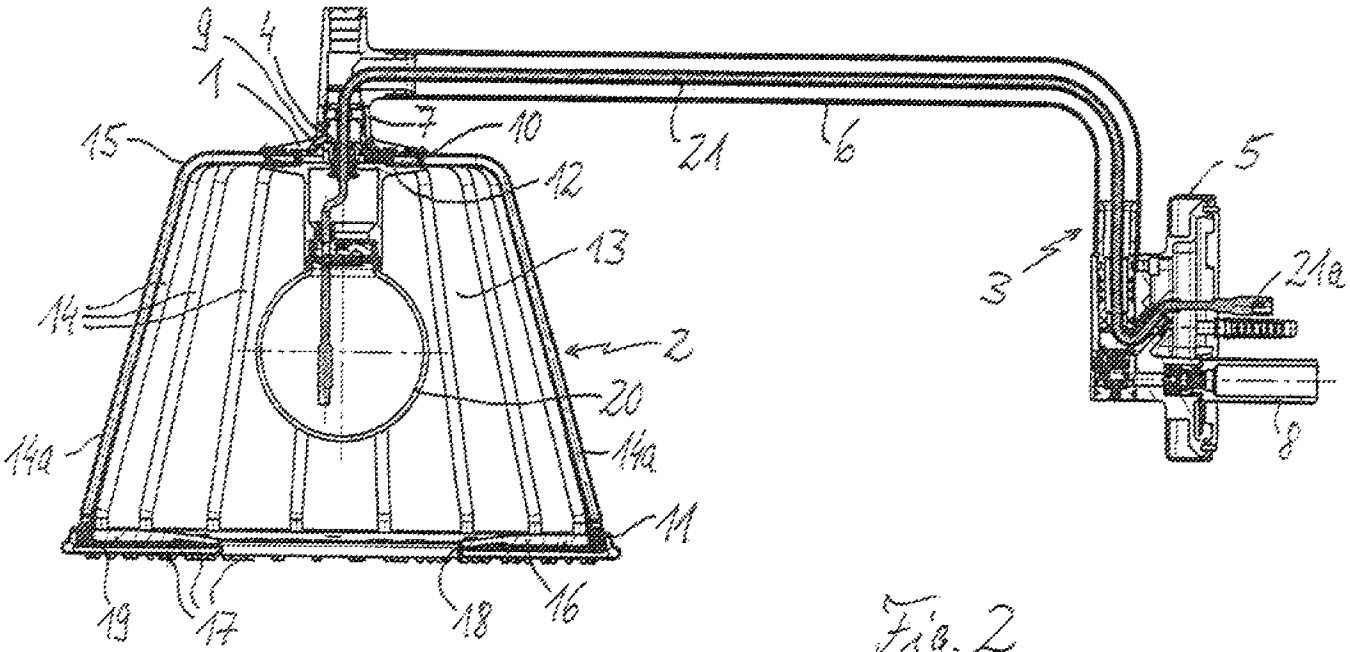
FIG. 2 shows a longitudinal sectional view of the head shower of FIG. 1.
Figure 3:
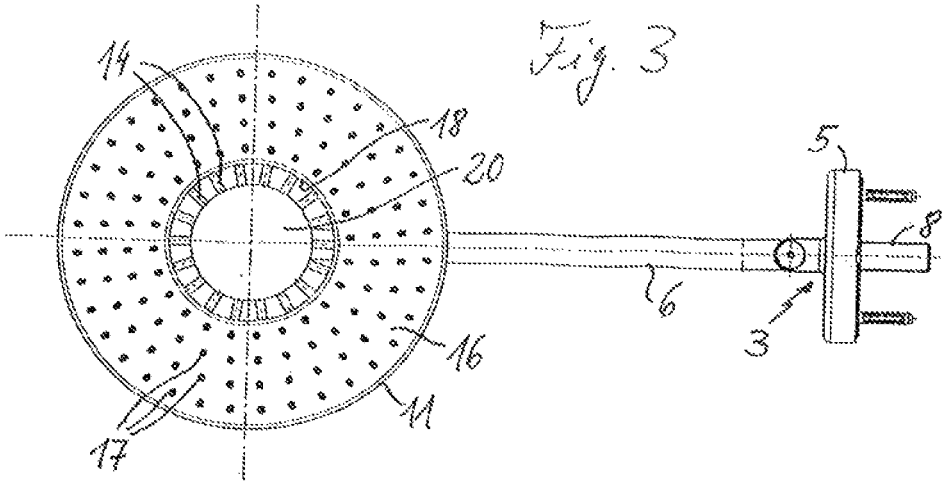
FIG. 3 shows a plan view from below onto the head shower of FIG. 1.

The sanitary shower shown in FIGS. 1 to 3 is implemented as a head shower having a disk-shaped connector body 1, a basket-type shower body 2 and a wall support 3 by way of which said sanitary shower can be fitted on a side wall of a shower room in a manner known per se and connected to a sanitary water supply there. The disk-shaped connector body 1, in the example shown, has centrically on its upper side a water inlet 4. The wall support 3 includes a disk-shaped wall-connector element 5 from which a support and supply tube 6, which is coupled to the water inlet 4 of the connector body 1 by way of a water-outlet section 7 pointing downward, extends initially vertically upwards and then horizontally. The support and supply tube 6 is implemented in a hollow and water-containing manner and serves both for supporting the sanitary shower on the respective shower wall and also for supplying shower water which, from the wall-side sanitary water supply via a water-inlet connector 8, which is coupled thereto, of the wall-connector element 5, enters in the support and supply tube 6 and from there via the water inlet 4 is routed into a water-distribution chamber 9 which is configured in the connector body 1.

The basket-type shower body 2 extends from an outer circumferential region 10 of the disk-shaped connector body 1 up to an outlet sided basket terminal 11 axially spaced from the connector body 1 and here defines a hollow basket interior space 13 adjacent to a lower disk main side 12 of the disk-shaped connector body 1.

The basket-type shower body 2, in the example shown, has an open, frame-like construction of a plurality of corresponding basket tubes 14 which are arranged in a distributed manner in the circumferential direction of the basket, so as to form a basket. In the case shown, these are eighteen basket tubes; alternatively, more or fewer basket tubes may be provided. The basket tubes 14 altogether form a bell shape for the shower body 2, wherein each basket tube 14 extends from the circumferential region 12 of the disk-shaped connector body 1 with a radial main direction component up to an upper basket circumferential region 15 and from there, being correspondingly curved, with an axial main direction component up to the outlet sided basket terminal 11.

Radial main direction component here means that the basket tubes 14, proceeding from the circumferential region 10 of the disk-shaped connector body 1 up to the upper basket circumferential region 15, extend in a direction which runs mainly radially, wherein additionally a comparatively minor direction component thereto may exist in the axial direction and/or in the circumferential direction. In an analogous manner, axial main direction component is to be understood to be a directional profile which lies predominantly in the axial direction, wherein additionally a minor direction component may exist in the radial direction and/or in the circumferential direction. Here, the axial direction is to be understood to be the direction of the longitudinal axis of the basket-type shower body 2 and of the disk-shaped connector body 1. In the example shown, the basket tubes 14 run horizontally from the disk-shaped connector body 1 up to the upper basket circumferential region 15 and then axially from there downwards and radially obliquely outwards up to the basket terminal 11. In as far as orientation terms such as vertical, horizontal, downwards and upwards are used there, it is understood that these indications are with respect to the fitted usage position of the sanitary shower on the respective shower wall.

The outlet sided basket terminal 11, in the example shown of FIGS. 1 to 3, is configured as an annular jet disk 16 which, on its upper side, is retained along a circumferential region on the lower ends of the basket tubes 14 and, on its lower side, is provided with a plurality of jet outlet openings 17. In the example shown the jet outlet openings 17 are arranged in a uniformly distributed manner over the annular face of the jet outlet disk 16 via four different radii. The annular jet outlet disk 16 delimits a centrical axial basket opening 18 through which the basket interior space 13 opens out towards the outside or downwards, respectively, that is to say on the basket side which is opposite the disk-shaped connector body 1.

For providing a fluid communication of the jet outlet openings 17 arranged on the outlet sided basket terminal 11 or on the jet disk 16, respectively, to the water inlet 4 or the water distribution chamber 9 in the connector body 1, respectively, the head shower has a corresponding water conduit which, in the example shown, is formed by at least one basket tube 14*a* from the plurality of basket tubes 14. To this end, the corresponding water containing basket tube 14*a* is radially inserted into the disk-shaped connector body 1 up to the latter's distribution chamber 9 and, with its lower end, opens into an associated distribution chamber 19 of the annular jet disk 16. Depending on requirements, only one basket tube 14*a* of the basket tubes 14 is water containing, or each basket tube 14 also forms a water containing tube 14*a*, or only part of the basket tubes 14 simultaneously functions as a water containing tube 14*a*. In the latter case, the water containing basket tubes 14*a* can be arranged along the basket circumference for example in a uniformly distributed manner, that is to say at substantially identical mutual angular spacing.

The head shower of FIGS. 1 to 3 furthermore includes an illuminant 20 which, by way of example, is an electric illuminant and which is disposed in the basket interior space 13. The electric illuminant 20 is positioned so as to be substantially centrical in the basket interior space 13 below the disk-shaped connector body 1 and is retained on the lower side 12 of the connector body 1 that faces the basket interior space 13. An electrical power supply line 21 leads to the electric illuminant 20, which electrical supply line 21, from the illuminant 20, is routed through the connector body 1 and passes through the latter's water inlet 4 and through the support and supply tube 6 to the wall-connector element 5, where it is connectable by way of its electrical connector 21*a* to an electric supply line provided in the respective shower wall. The support and supply tube 6 and the water inlet 4 of the connector body 1, therefore, are used for supplying water and also for passing through the electric supply line 21 of the illuminant 20.

From below the illuminant 20 remains visible through the axial basket opening 18. During operation the illuminant 20 correspondingly beams a light cone downwards through the basket opening 18 which has been left free by the annular jet disk 16. The basket frame of the shower body 2 which is formed by the basket tubes 14 surrounds the illuminant 20 in a lampshade-like manner. If, as is the case in the example shown, the basket frame is open, the illuminant 20 also beams light laterally, through between the basket tubes 14. In alternative embodiments the shower basket 2 is implemented in a closed manner on account of a cover retained on the basket tubes 14, via which cover at the most diffuse light, again in a lampshade-like manner, is laterally beamed away. During active operation of the shower, the light cone which is beamed downwards, through the axial outlet sided basket opening 18, is surrounded by the water jets exiting from the jet outlet openings 17 or superimposed in a downwards direction by said water jets, respectively, so that a corresponding illuminated jet pattern results.

It goes without saying that in alternative embodiments the head shower of FIGS. 1 to 3 can be used also without the illuminant 20 and the associated power supply 21.

Figure 4:
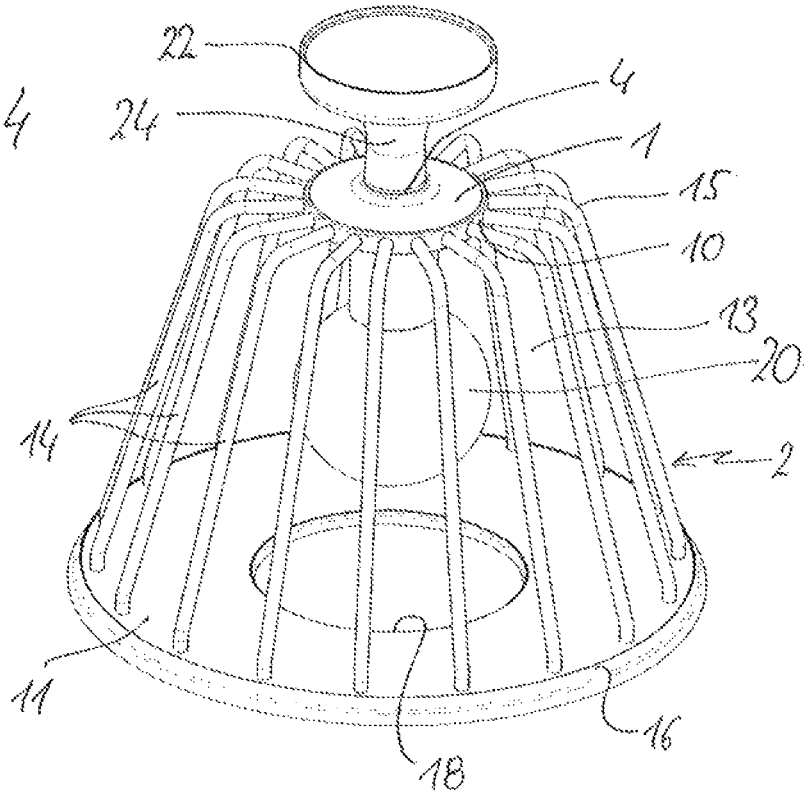
FIG. 4 shows a head shower having a ceiling support, and the same shower body as the head shower of FIGS. 1 to 3.
Figure 5:
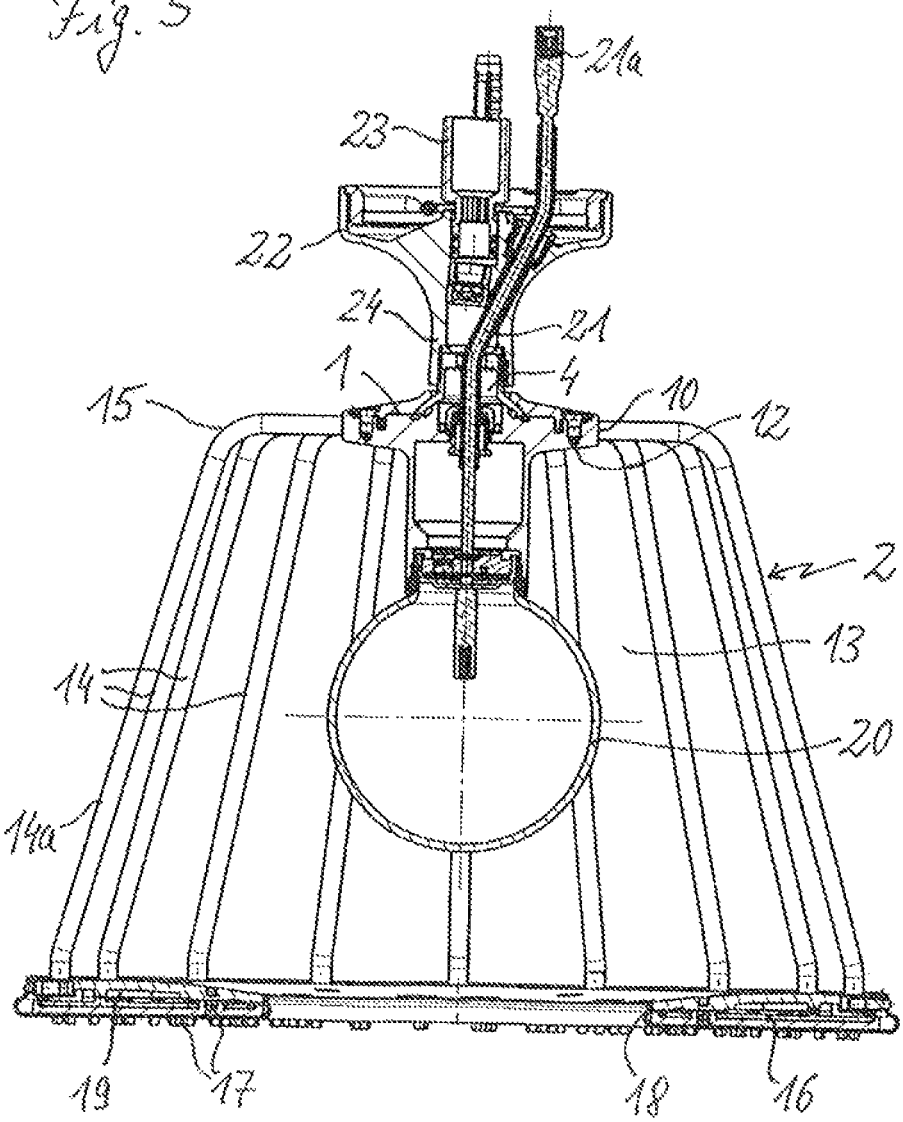
FIG. 5 shows a longitudinal sectional view of the head shower of FIG. 4.

FIGS. 4 and 5 illustrate a head shower which is designed for fitting on a ceiling wall of a shower room and which, with the exception of this other type of fastening, corresponds to the shower head of FIGS. 1 to 3, wherein for clarity the same reference signs are used for identical and functionally equivalent elements and reference may be made to this extent to the above explanations with respect to the exemplary embodiment of FIGS. 1 to 3. In particular, a disk-shaped connector body 1 of practically identical construction and the same basket-type shower body 2 are used in the head shower of FIGS. 4 and 5. A ceiling connector element 22, which can be coupled by way of an inlet connector to a ceiling-side connector of a sanitary water supply and which is coupled by way of a water outlet connector 24 on the water inlet 4 of the connector body 1, serves to support the head shower on a ceiling wall of a shower room.

The illuminant 20, to which an electric supply line 21 leads, is again provided in the basket interior space 13. In this case, the electric supply line 21, after passing through the connector body 1 and the latter's water inlet 4, is routed via the ceiling connector element 22 upwards where said electric supply line 21, by way of its connector end 21*a*, can be connected to a ceiling-side electric supply line of the shower room.

With the exception of the difference in the fitting on the ceiling wall instead of on the side wall of the shower room, the head shower of FIGS. 4 and 5 completely corresponds to that of FIGS. 1 to 3 in terms of functions and the advantages achievable therewith, as explained above with reference to the shower of FIGS. 1 to 3.

Figure 6:
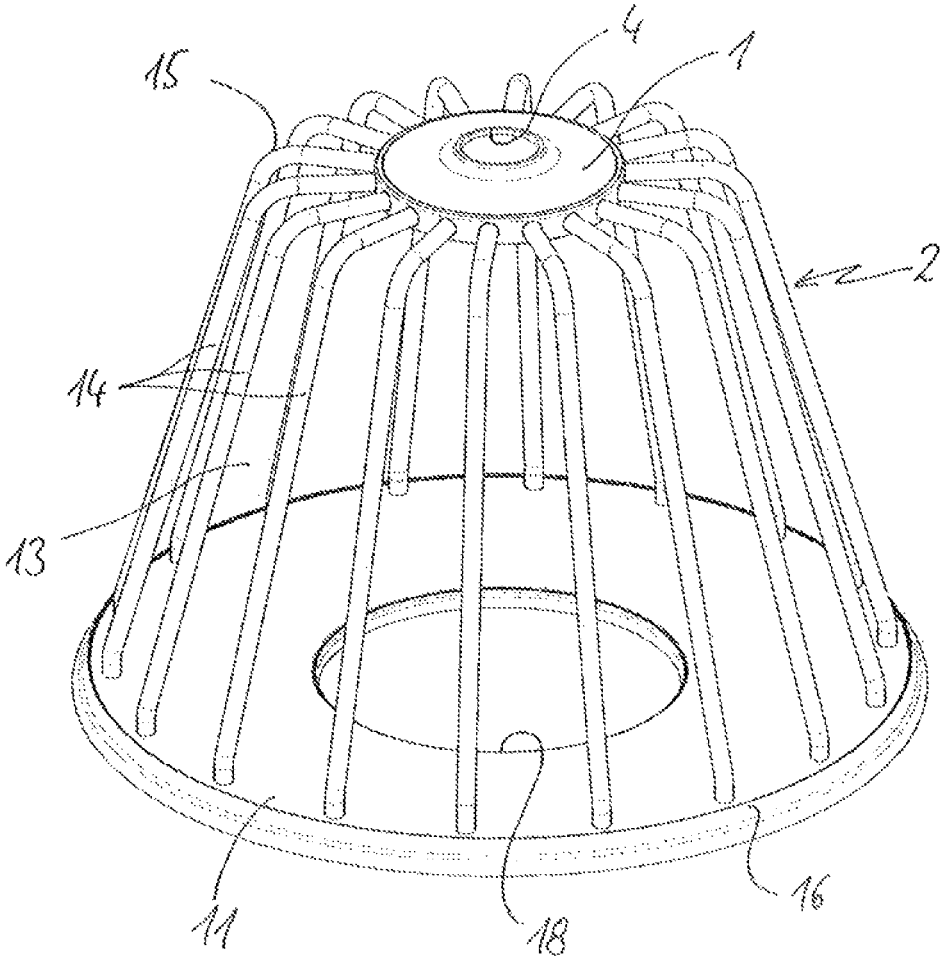
FIG. 6 shows a perspective view of the basket-type shower body of the showers in FIGS. 1 to 5.

FIG. 6 separately shows the unit of a disk-shaped connector body 1, used in the head showers of FIGS. 1 to 5, having the upper-side water inlet 4 and comprising the shower basket 2 extending therefrom radially outwards and downwards, the outlet sided basket terminal 11 of said shower basket 2 containing the annular jet disk 16 having the centric axial basket opening 18 which opens out downwards from the bell-shaped basket interior space 13 which is delimited by the basket tubes 14.

Figure 7:
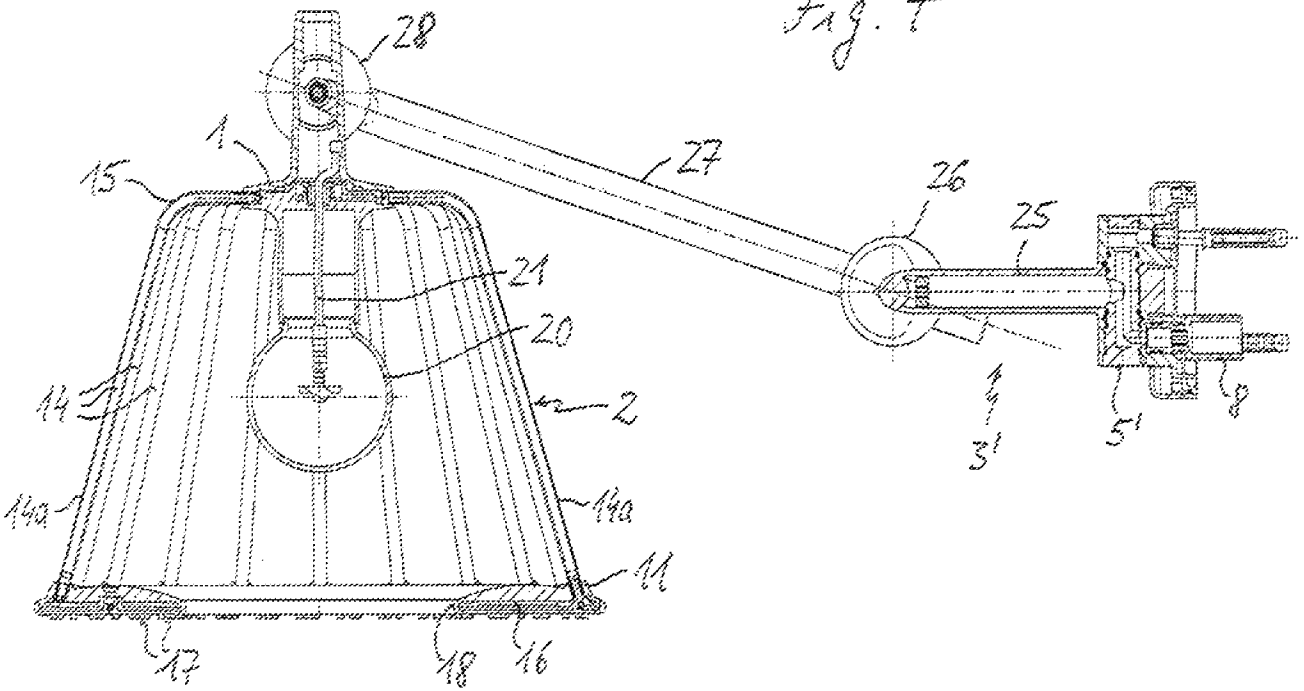
FIG. 7 shows a longitudinal sectional view corresponding to FIG. 2, for a head-shower variant having a positional adjustment.

FIG. 7 shows a variant of the head shower of FIGS. 1 to 3, which substantially only differs therefrom by way of a modified wall support 3' which enables a positional adjustment of the unit comprising the connector body 1 and the basket-type shower body 2. To this end, the wall support 3' has a wall-connector element 5', having a horizontally branching tubular connector 25, and a first pivot joint 26 which couples a hollow support and supply tube 27 in a pivotably movable manner and in fluid communication to the tubular connector 25. On the other end of the support and supply tube 27 a second pivot joint 28 is provided, by way of which the unit comprising the connector body 1 and the shower basket 2 is articulated on the support and supply tube 27 in a pivotably movable manner. Otherwise, the head shower of FIG. 7, in terms of its functions and properties, corresponds to that of FIGS. 1 to 3, with respect to which reference can be made to the above explanations thereof.

Figure 8:
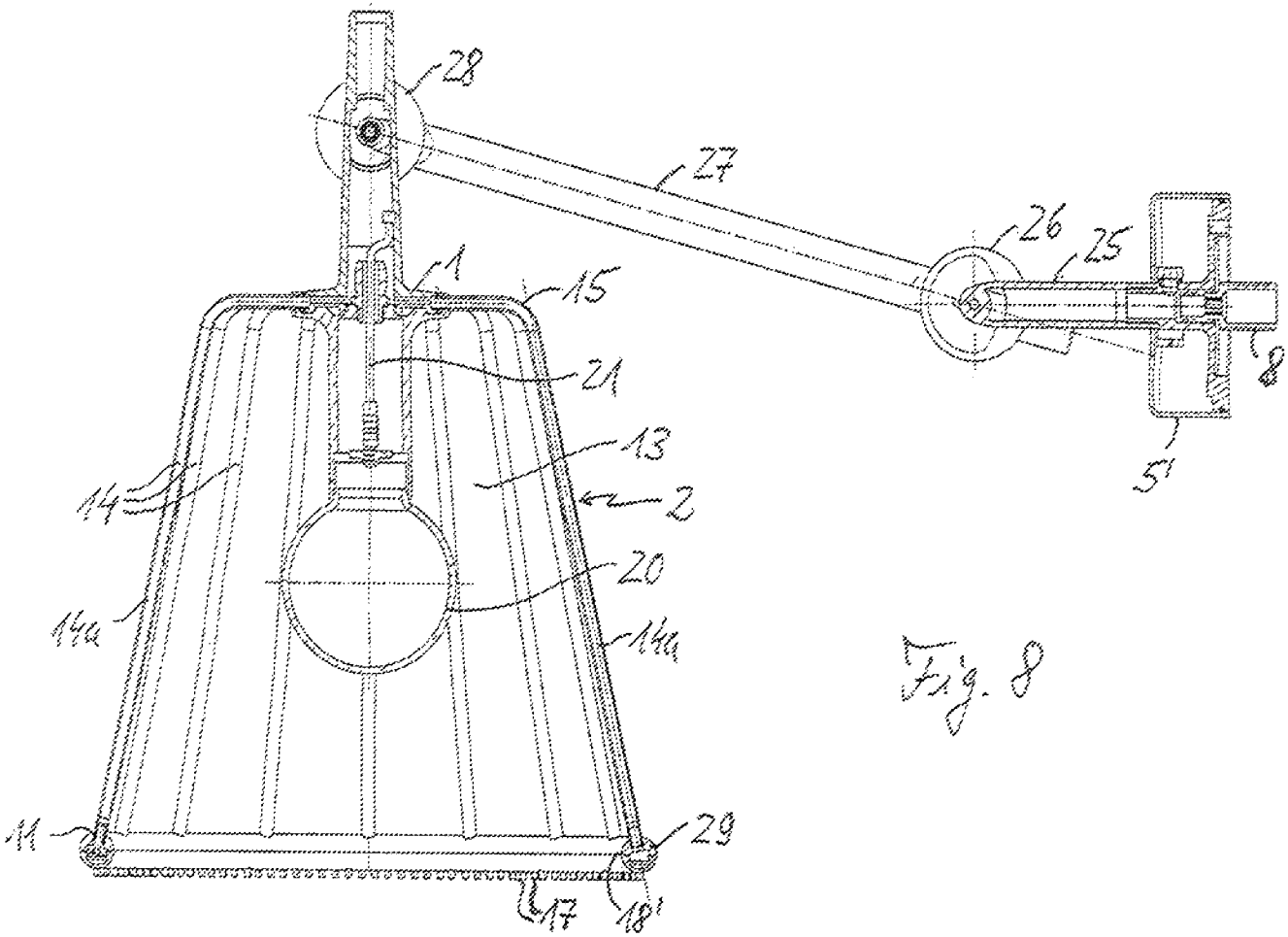
FIG. 8 shows a side view corresponding to FIG. 7, for a head-shower variant having an annular jet outlet tube on the basket outlet.
Figure 9:
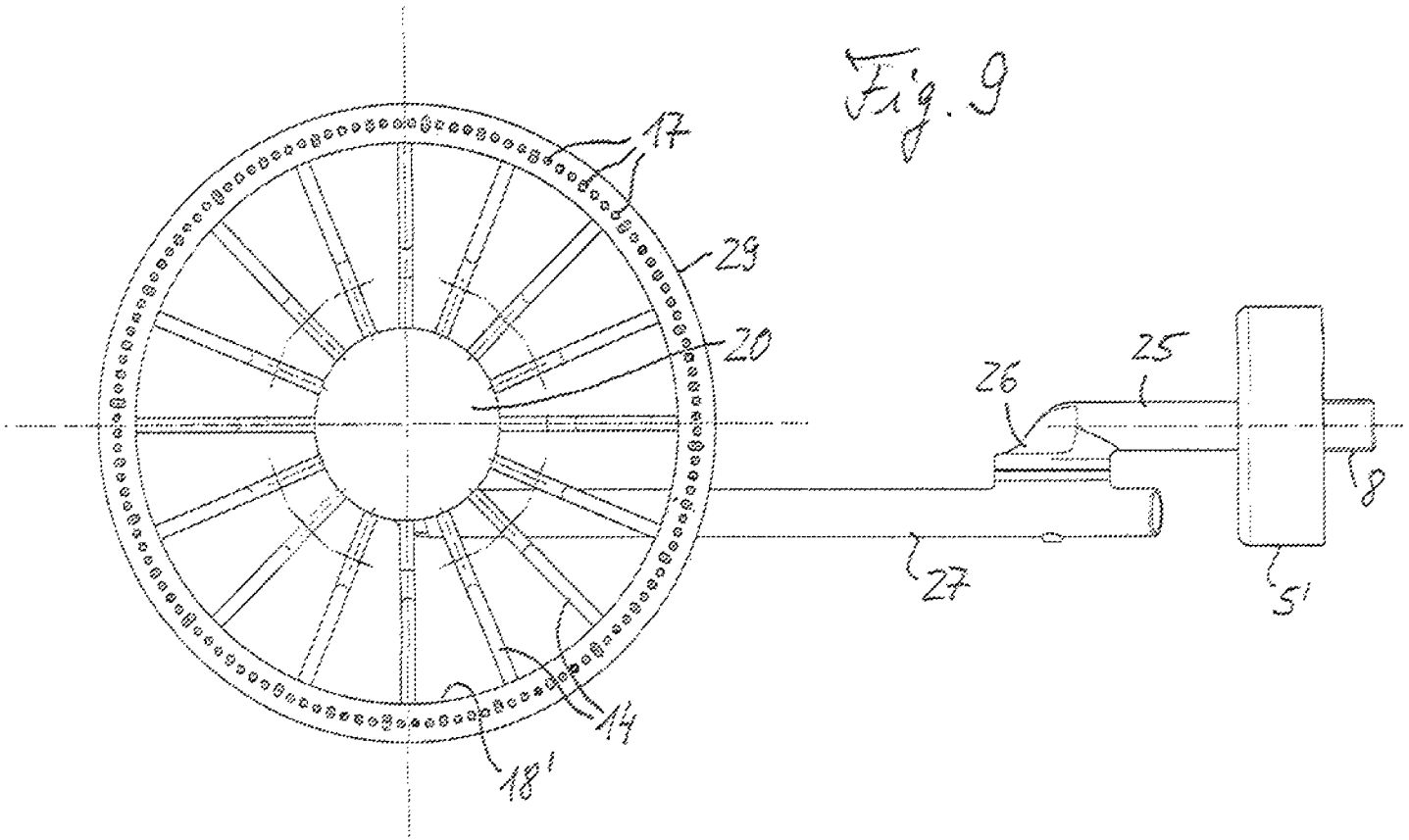
FIG. 9 shows a plan view from below onto the head shower of FIG. 8.

FIGS. 8 and 9 show a variant of the head shower of FIG. 7, which differs from the latter by way of a modified basket-type shower body 2 which has a more elongate bell shape and the outlet sided basket terminal 11 of which includes an annular jet outlet tube 29 which, on its lower-side tube-jacket face, is provided with a plurality of jet outlet openings 17 which are arranged in one row uniformly distributed in the circumferential direction. The jet outlet tube 29 delimits a lower axial basket opening 18' which, in this case, corresponds to practically the entire cross-sectional face of the outlet sided basket terminal 11.

Again, at least one of the basket tubes 14 is configured as a water containing tube 14*a* which functions as a corresponding part of the water conduit from the connector body 1 to the annular jet outlet tube 29, of which the hollow tubular interior forms a water-distribution chamber for the lower-side jet outlet openings 17.

As a result, the head shower of FIGS. 8 and 9 delivers a narrow annular jet pattern on account of the water jets exiting from the one row of jet outlet openings 17 of the annular jet outlet tube 29. During a shower operation, the illumination light on account of the illuminant 20 disposed in the basket interior space 13 may be added additionally to this jet pattern.

Figure 10:
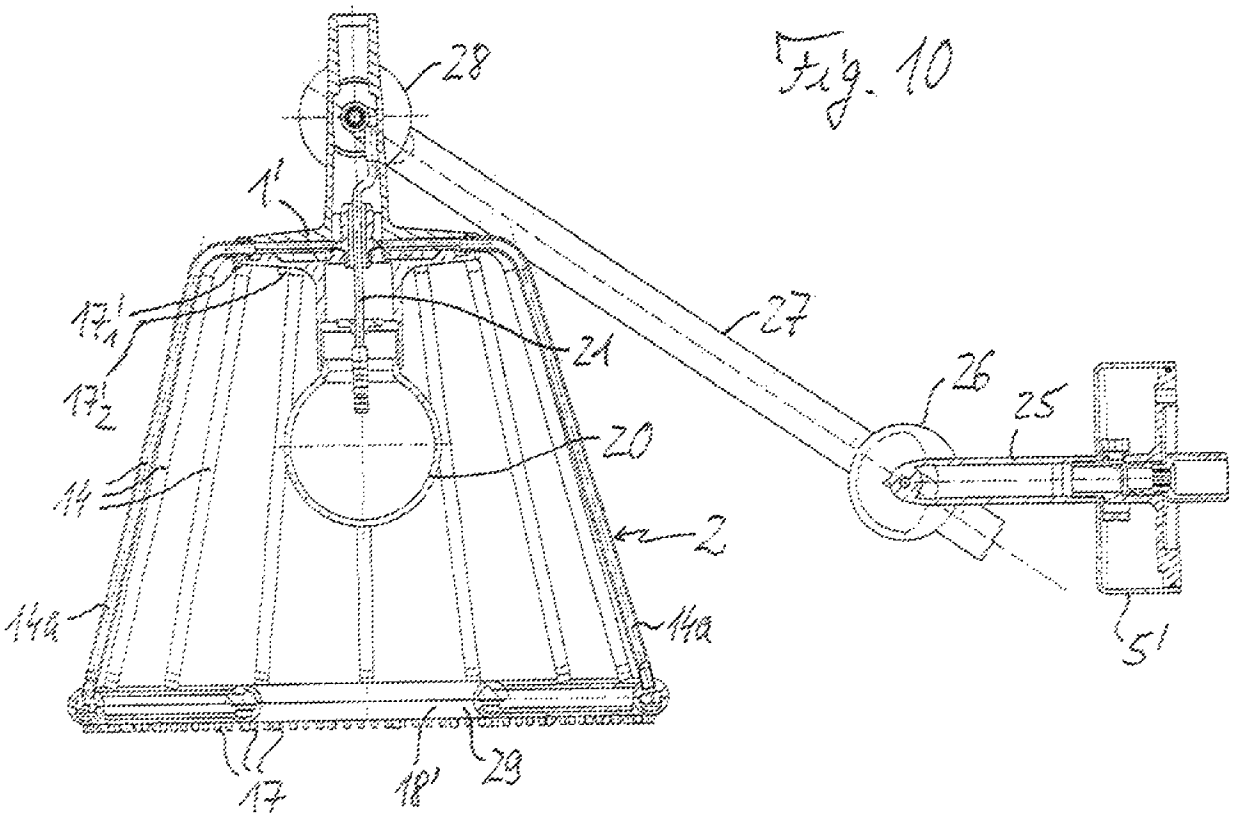
FIG. 10 shows a longitudinal sectional view corresponding to FIG. 8, for a head-shower variant having additional jet outlet openings on the connector body.
Figure 11:
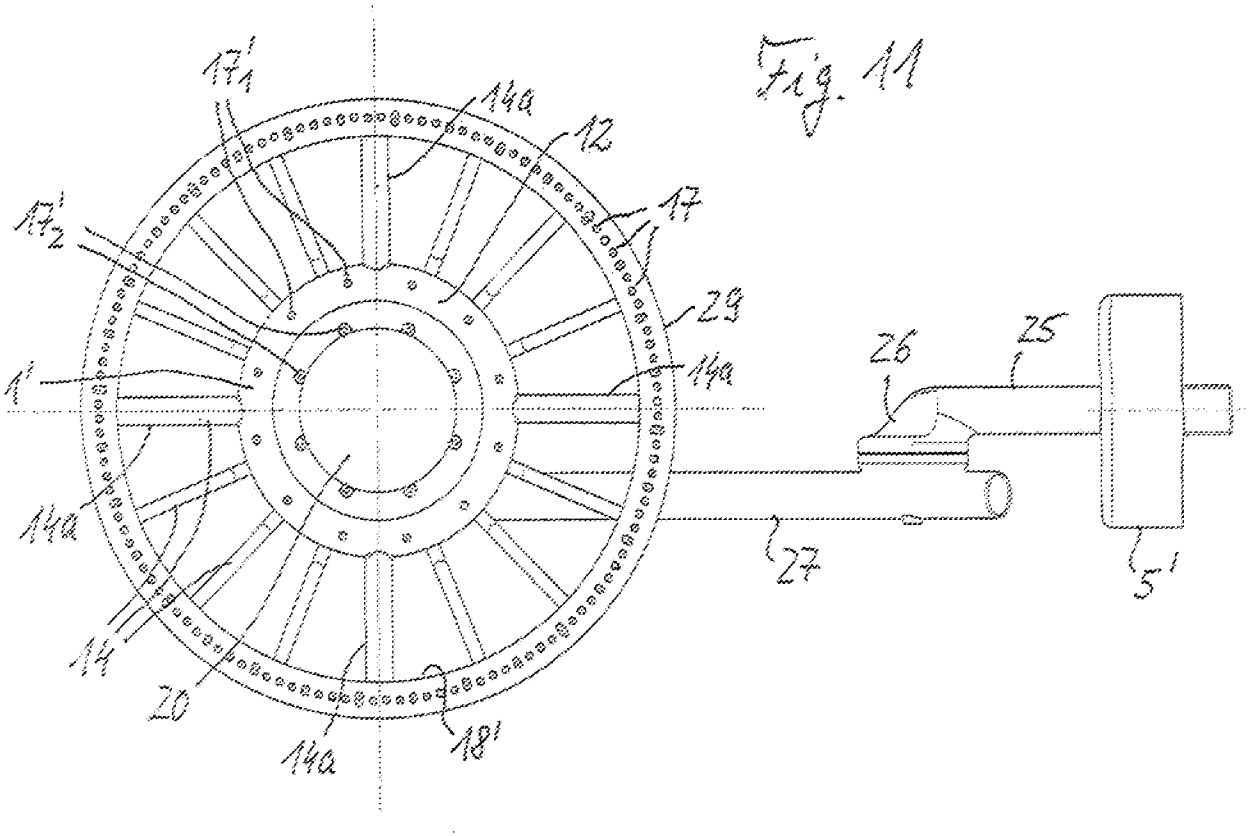
FIG. 11 shows a plan view from below onto the head shower of FIG. 10.

FIGS. 10 and 11 illustrate a further variant of the head shower of FIG. 7, having the same shape as the shower basket 2, but having the annular jet outlet tube on the outlet sided basket terminal 11, corresponding to the shower variant of FIG. 8, instead of the jet disk 16. Additionally, a plurality of jet outlet openings $\mathbf{17'}_1$, $\mathbf{17'}_2$ are provided in the head shower of FIGS. 10 and 11 on the lower side 12 facing the basket interior space of a connector body 1' modified to this extent. These additional jet outlet openings $\mathbf{17'}_1$, $\mathbf{17'}_2$ are arranged in a distributed manner on an outer radius or an inner radius, respectively, on the connector body 1'.

Thus, in the case of the shower of FIGS. 10 and 11 a jet pattern results in which, additionally to the water jets which exit on the outlet sided basket terminal 11 from the annular jet outlet tube 29 there and the latter's jet outlet openings 17, water jets which lie radially farther inwards are present, which exit on the underside 12 of the connector body 1' from the jet outlet openings $\mathbf{17'}_1$, $\mathbf{17'}_2$ there into the basket interior space 13, axially traverse the basket interior space 13 while passing the illuminant 20, and exit through the outlet sided basket opening 18' from the shower basket 2. Additionally, the illuminant 20 may provide an associated illumination.

Figure 12:
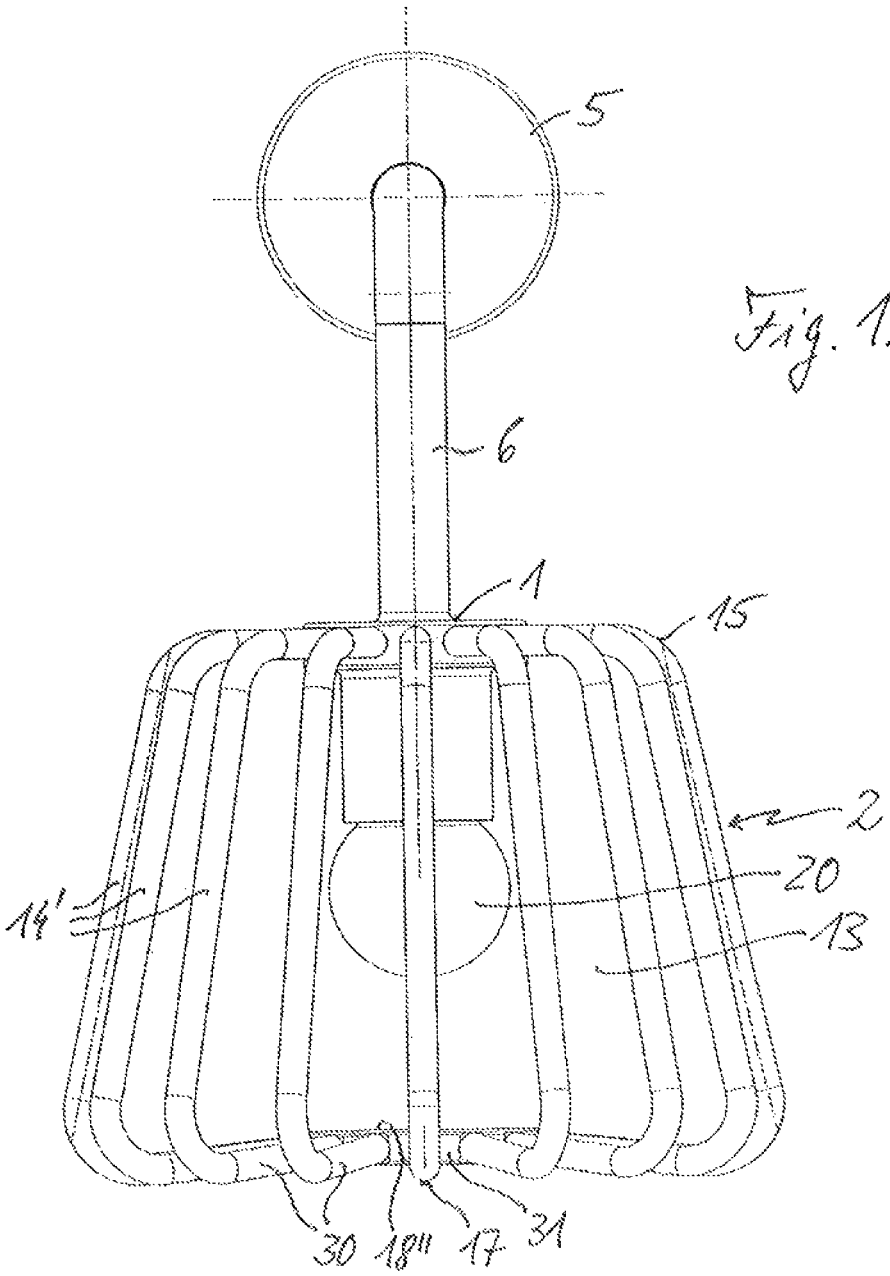
FIG. 12 shows a side view of a further head shower having a wall support, having radial jet outlet tubes on the basket terminal.
Figure 13:
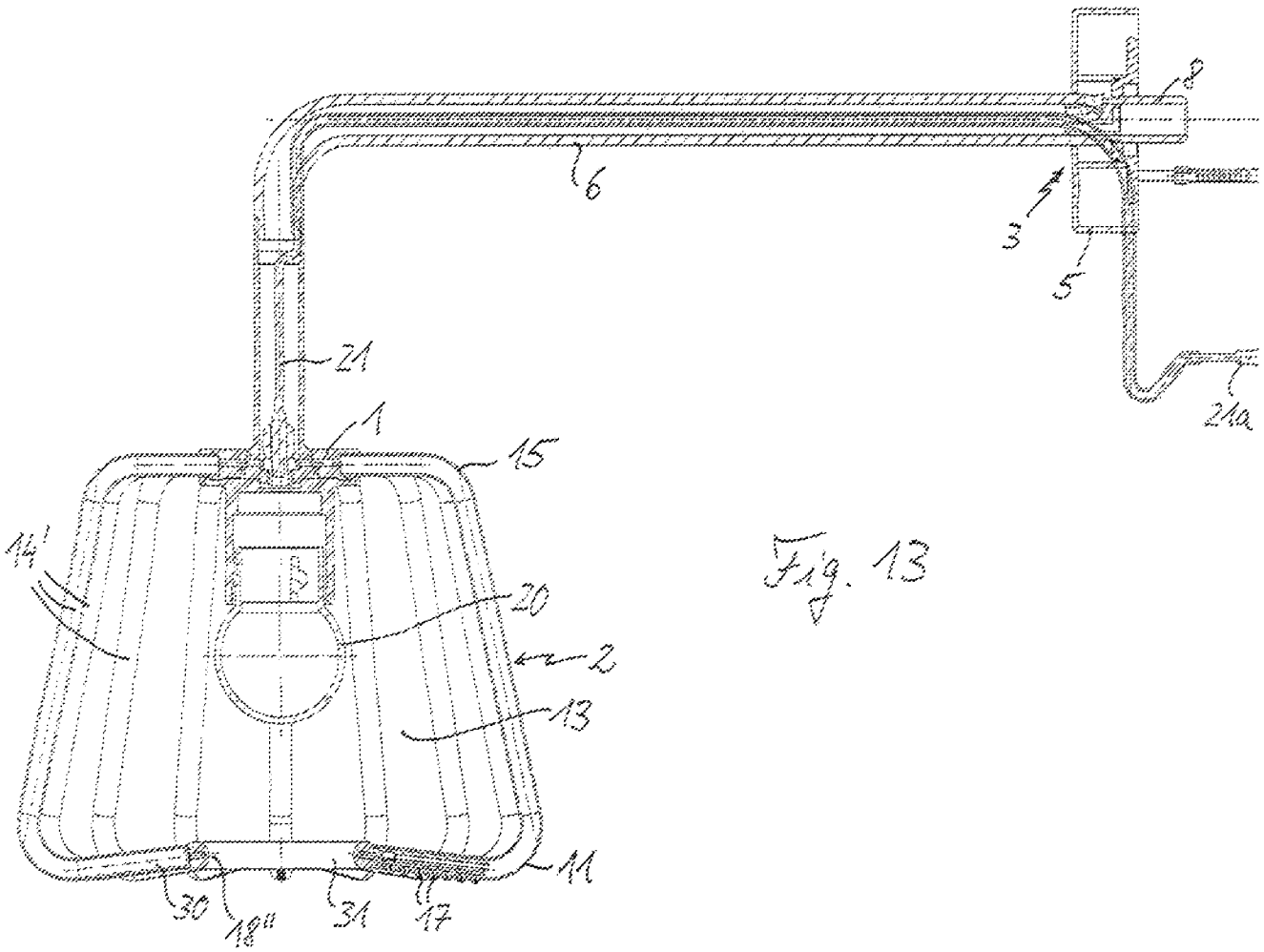
FIG. 13 shows a longitudinal sectional view of the head shower of FIG. 12.
Figure 14:
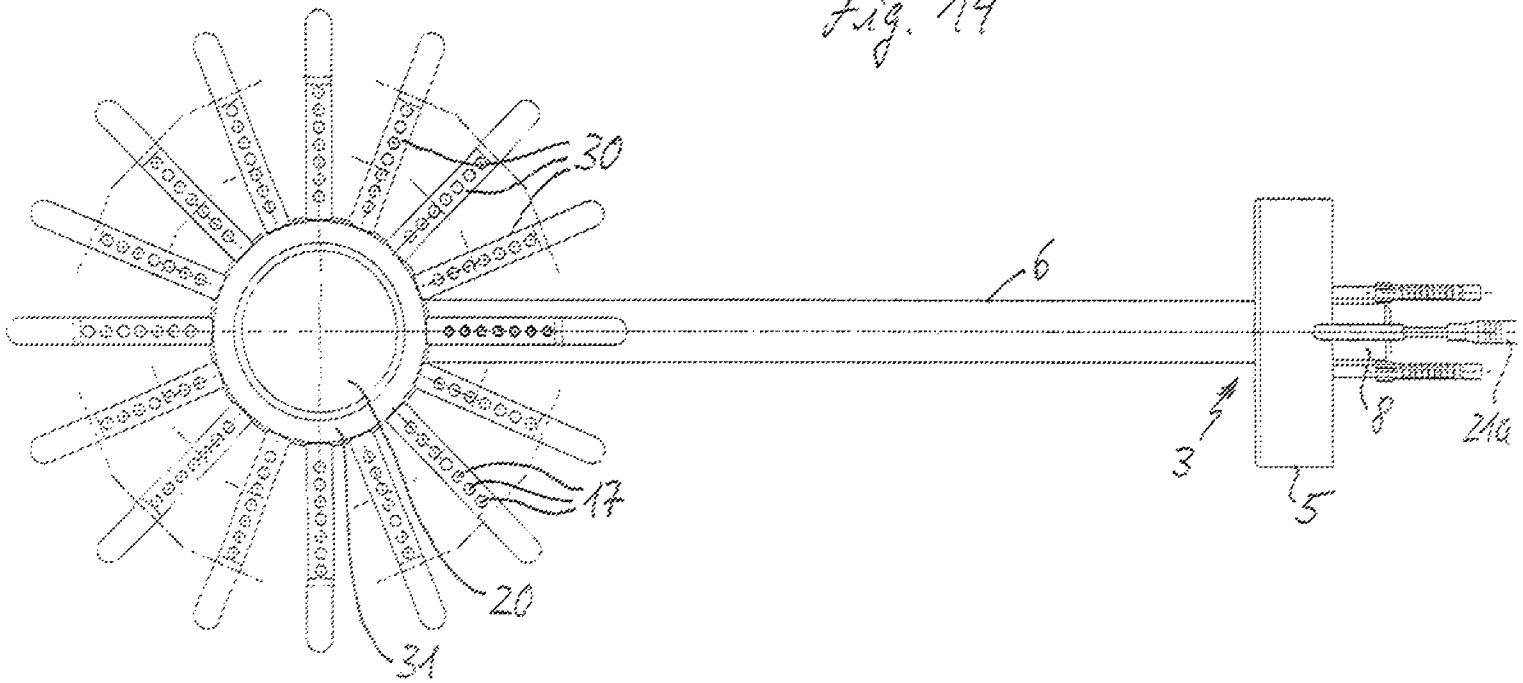
FIG. 14 shows a plan view from below onto the head shower of FIG. 12.

FIGS. 12 to 14 illustrate a variant of the head shower of FIGS. 1 to 3, in which the shower body 2 is modified in particular in its outlet sided basket terminal 11. In this exemplary embodiment the basket terminal 11 particularly includes a plurality of radial jet outlet tubes 30 which, on the lower side on their tube-jacket face, are in each case provided with a plurality of jet outlet openings 17 arranged in a row. In the example shown, the radial jet outlet tubes 30 are formed in one part as a corresponding part of correspondingly modified basket tubes 14'. To this end the basket tubes 14' which form the shower basket 2, in the region of the outlet sided basket terminal 11, are curved in a radially inward manner, such that the curved radial tube end section forms the respective radial jet outlet tube 30, to which end said tube end section, on the lower side, is provided with the jet outlet openings 17. With their radially inner end the radial jet outlet tubes 30 extend up to a retaining ring 31 on which they are collectively secured. The retaining ring 31 delimits a corresponding lower axial basket opening 18", of which the inner diameter in the example shown corresponds approximately to the diameter of the illuminant 20 accommodated in the basket interior space 13.

In this exemplary embodiment each basket tube 14' is also designed so as to be water containing, that is to say the shower water which is supplied to the connector body 1 reaches in a hydraulically parallel manner all basket tubes 14' and therein up to the outlet sided end sections thereof which form the radial jet outlet tubes 30, from where said shower water exits downwards through the jet outlet openings 17. In the example shown, the radial jet outlet tubes 30 run radially inwards in a direction which is slightly axially sloped upwards. In alternative embodiments the radial jet outlet tubes 30 are disposed exactly horizontal or having a radially inward direction component which is slightly axially sloped outwards or downwards, respectively. It goes without saying that, in alternative embodiments, the radial jet outlet tubes may be formed as tubes which are separate from the basket tubes and which are then connected to the basket tubes.

The head shower of FIGS. 12 to 14 accordingly delivers a jet pattern which results from the radial rows of the jet outlet openings 17. An illumination pattern may be combined herewith upon activating the illuminant 20, in which the illumination light exits both through the axial basket outlet opening 18" and downwards out of the shower basket 2 through the intermediate spaces between the radial jet outlet tubes 30.

As can be seen from the exemplary embodiments shown and explained above, the invention provides a sanitary shower which, in its various possible embodiments, enables a great variety in terms of shape and function, in particular with respect to providing different jet patterns of the shower jet and the additional illumination function which can be optionally provided. In the exemplary embodiments shown the outlet sided basket terminal delimits in each case one axial basket opening. In alternative embodiments, the axial basket opening is replaced entirely or at least in regions by a light transparent terminal disk element. This enables additional effects of the illumination function, for example by using a terminal disk which provides transparent or diffuse transmitted light. In a similar manner, the shower basket may be implemented in a closed manner laterally by way of a light-tight or partially transparent cover instead of the open tubular basket frame.

In the exemplary embodiments shown, the sanitary shower according to the invention is in each case implemented as a head shower. In alternative embodiments it may also be implemented as a side shower or as a hand shower. In the case of the latter, the support and supply tube is then configured as a commonplace hand-shower handle which can be connected to a commonplace shower hose.

The invention claimed is:

1. A sanitary shower comprising a connector body including a water inlet connectable to a wall supply line, a basket-type shower body which extends from the connector body up to an outlet sided basket terminal axially spaced from the connector body, wherein the basket-type shower body defines a hollow basket interior space adjacent to the connector body, and the outlet sided basket terminal delimits at least one of an axial basket opening and a light transparent terminal disk element, wherein the basket-type shower body includes a plurality of basket tubes arranged and distributed over a circumferential direction of the hollow basket interior space to form a basket, at least one jet outlet opening provided on at least one of the basket-type shower body and the connector body, and a water conduit providing a fluid communication of the at least one jet outlet opening to the water inlet.

2. The sanitary shower according to claim 1, wherein the basket-type shower body extends from the connector body in a bell shape with a radial main direction component up to an upper basket circumferential region and from there with an axial main direction component up to the outlet sided basket terminal.

3. The sanitary shower according to claim 1, wherein the outlet-sided basket terminal includes a plurality of jet outlet openings.

4. The sanitary shower according to claim 3, wherein the outlet-sided basket terminal includes an annular jet outlet disk having at least one jet outlet opening.

5. The sanitary shower according to claim 1, wherein a jet outlet region includes a plurality of jet outlet openings in a plane.

6. The sanitary shower according to claim 1, wherein a plurality of jet outlet openings are arranged in different angles relative to one another.

7. The sanitary shower according to claim 1, wherein the basket-type shower body includes at least one water containing tube , said tube forming a component of the water conduit.

8. The sanitary shower according to claim 1, wherein the connector body includes one or more jet outlet openings on an outlet side facing the basket interior space.

9. The sanitary shower according to claim 1, further comprising an illuminant disposed in the basket interior, which illuminant is attached to one of the connector body and the basket-type shower body.

10. The sanitary shower according to claim 9, wherein the illuminant is an electric illuminant, electrically connected to an electric power supply line, which power supply line is passed through the water inlet.

11. The sanitary shower according to claim 1, further comprising a support and supply tube, in the form of one of an overhead shower wall support, an overhead shower ceiling support, a lateral shower wall support, and a hand-held shower handle, and includes a water outlet section configured to be coupled to the water inlet of the connector body.

12. The sanitary shower according to claim 3, wherein the outlet-sided basket terminal includes a light transparent jet outlet disk having at least one jet outlet opening.

13. The sanitary shower according to claim 3, wherein the outlet-sided basket terminal includes at least one annular jet outlet tube having at least one jet outlet opening on a tube jacket side.

14. The sanitary shower according to claim 3, wherein the outlet-sided basket terminal includes at least one radial jet outlet tube having at least one jet outlet opening on a tube jacket side.

15. The sanitary shower according to claim 5, wherein said jet outlet openings are disposed in one of a round arrangement and circumferentially in an annular arrangement.

16. The sanitary shower according to claim 5, wherein at least two jet outlet regions are provided, each including a plurality of jet outlet openings.

17. The sanitary shower according to claim 6, wherein said plurality of jet outlet openings are arranged in groups, said groups of jet outlet openings being provided along one of closed lines and rings.

18. The sanitary shower according to claim 17, wherein said groups of jet outlet openings are provided in one plane.

* * * * *